US006705087B1

(12) United States Patent
Ohri et al.

(10) Patent No.: US 6,705,087 B1
(45) Date of Patent: Mar. 16, 2004

(54) SWIRLER ASSEMBLY WITH IMPROVED VIBRATIONAL RESPONSE

(75) Inventors: Rajeev Ohri, Winter Springs, FL (US); David M. Parker, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/244,068

(22) Filed: Sep. 13, 2002

(51) Int. Cl.[7] ..... F02C 7/22
(52) U.S. Cl. ..... 60/748
(58) Field of Search ..... 60/748; 239/403, 239/405

(56) References Cited

U.S. PATENT DOCUMENTS

| | | | | |
|---|---|---|---|---|
| 3,273,343 A | * | 9/1966 | Cretalla | 60/748 |
| 3,739,576 A | * | 6/1973 | Chamberlain | 60/738 |
| 3,975,141 A | | 8/1976 | Sweet | |
| 3,980,233 A | | 9/1976 | Simmons et al. | |
| 4,633,667 A | | 1/1987 | Watanabe et al. | |
| 5,123,248 A | | 6/1992 | Monty et al. | |
| 5,228,283 A | | 7/1993 | Sciocchetti | |
| 5,253,478 A | * | 10/1993 | Thibault et al. | 60/733 |
| 5,337,961 A | | 8/1994 | Brambani et al. | |
| 5,355,670 A | | 10/1994 | Sciocchetti | |
| 5,605,287 A | | 2/1997 | Mains | |
| 5,749,218 A | | 5/1998 | Cromer et al. | |
| 5,761,897 A | | 6/1998 | Kramer | |
| 5,899,075 A | * | 5/1999 | Dean et al. | 60/737 |
| 5,996,352 A | | 12/1999 | Coughlan et al. | |
| 6,026,645 A | | 2/2000 | Stokes et al. | |
| 6,240,731 B1 | | 6/2001 | Hoke et al. | |
| 6,276,141 B1 | | 8/2001 | Pelletier | |
| 6,327,861 B2 | | 12/2001 | Sato et al. | |
| 2001/0020364 A1 | | 9/2001 | Sato et al. | |

* cited by examiner

*Primary Examiner*—Ehud Gartenberg

(57) ABSTRACT

A turbo machinery assembly, having a natural frequency outside of the range of operational vibrational forces and further having increased damping capability, comprises a turbo machinery component and a plate having an elongated opening defining an inner surface. The turbo machinery component has a first end and a second end; the second end having an outer profile that extends inside the opening, contacting portions of the inner surface and extending peripherally to regions of clearance with the inner surface. The second end of the turbo machinery component may also extend beyond the inner surface. The turbo machinery component may further include a sleeve having a proximal end and a distal end. The second end of the turbo machinery component extends into the sleeve through the proximal end. The distal end of the sleeve defines the second end of the turbo machinery component extending inside the inner surface.

14 Claims, 4 Drawing Sheets

SWIRLER ASSEMBLY WITH IMPROVED VIBRATIONAL RESPONSE

CROSS REFERENCE TO RELATED APPLICATIONS (Not Applicable)

STATEMENT REGARDING FEDERALLY SPONSORED RESEARCH (Not Applicable)

FIELD OF THE INVENTION

The present invention relates in general to gas turbines and, more particularly, to swirler assemblies.

BACKGROUND OF THE INVENTION

Gas turbines generally comprise the following elements: a compressor for compressing air; a combustor for producing a hot gas by burning fuel in the presence of the compressed air produced by the compressor; and a turbine for expanding the hot gas produced by the combustor.

As shown in FIG. 1, an example of a prior art gas turbine combustor 10 comprises a nozzle housing 12 having a nozzle housing base 14. A diffusion fuel pilot nozzle 16, having a pilot fuel injection port 18, extends through nozzle housing 12 and is attached to nozzle housing base 14. In the shown configuration, main fuel nozzles 20, each having at least one main fuel injection port 22, extend substantially parallel to pilot nozzle 16 through nozzle housing 12 and are attached to nozzle housing base 14. Fuel inlets 24 provide fuel 26 to main fuel nozzles 20. A main combustion zone 28 is formed within a liner 30. A pilot cone 32, having a diverged end 34, projects from the vicinity of pilot fuel injection port 18 of pilot nozzle 16. Diverged end 34 is downstream of main fuel swirlers 36. A pilot flame zone 38 is formed within pilot cone 32 adjacent to main combustion zone 28.

Compressed air 40 from compressor 42 flows between support ribs 44 through main fuel swirlers 36. Each main fuel swirler 36 is substantially parallel to pilot nozzle 16 and adjacent to main combustion zone 28. Within each main fuel swirler 36, a plurality of swirler vanes 46 generate air turbulence upstream of main fuel injection ports 22 to mix compressed air 40 with fuel 26 to form a fuel/air mixture 48. Fuel/air mixture 48 is carried into main combustion zone 28 where it combusts. Compressed air 50 enters pilot flame zone 38 through a set of stationary turning vanes 52 located inside pilot swirler 54. Compressed air 50 mixes with pilot fuel 56 within pilot cone 32 and is carried into pilot flame zone 38 where it combusts.

FIG. 2 shows a detailed view of an exemplary prior art fuel swirler 36. As shown in FIG. 2, fuel swirler 36 is substantially cylindrical in shape, having a flared inlet end 58 and a tapered outlet end 60. A plurality of swirler vanes 46 are disposed circumferentially around the inner perimeter 62 of fuel swirler 36 proximate flared end 58. In the shown configuration, fuel swirler 36 surrounds main fuel nozzle 20 proximate main fuel injection ports 22. Fuel swirler 36 is positioned with swirler vanes 46 upstream of main fuel injection ports 22 and tapered end 60 adjacent to main combustion zone 28. Flared inlet end 58 is adapted to receive compressed air 40 and channel it into fuel swirler 36. Tapered outlet end 60 is adapted to fit into sleeve 64. Swirler vanes 46 are attached to a hub 66. Hub 66 surrounds main fuel nozzle 20.

FIG. 3 shows an upstream view of combustor 10. Pilot nozzle 16 is surrounded by pilot swirler 54. Pilot swirler 54 has a plurality of stationary turning vanes 52. Pilot nozzle 16 is surrounded by a plurality of main fuel nozzles 20. A main fuel swirler 36 surrounds each main fuel nozzle 20. Each main fuel swirler 36 has a plurality of swirler vanes 46. The diverged end 34 of pilot cone 32 forms an annulus 68 with liner 30. Main fuel swirlers 36 are upstream of diverged end 34. Fuel/air mixture 48 flows through annulus 68 (out of the page) into main combustion zone 28 (not shown in FIG. 3).

Fuel swirler 36 is attached to liner 30 via attachments 70 and swirler base 72. With respect to the latter manner of attachment, the distal end of sleeve 74 is adjacent to the swirler base plate 72 as shown in FIG. 2. The distal end of sleeve 74 and the base plate 72 typically do not come into contact and are actually spaced approximately 10 mils apart. FIG. 3 shows a circular array of six swirlers, but other quantities, such as a series of eight swirlers, can be employed.

The other manner of attaching the swirler 36 to liner 30 is by way of attachments 70. In initial designs, attachments 70 comprised dual straight pins, each pin being welded at one end to liner 30 and at the other end to the swirler 36. This design, however, often fails due to fatigue induced cracking of the pins at the support casing. One prior design revision includes replacing the straight pin attachments with hourglass-shaped pins (as shown) to provide improved weld areas on both the swirler 36 and the liner 30. However, this design also suffers from fatigue-related failures, primarily occurring at the weld joint between the hourglass-shaped pin attachments 70 and the swirler 36.

The fatigue failures stem from a swirler's exposure to vibrational forces generated during combustor operation. Combustion dynamics typically range from approximately 110–150 Hz, although variations outside this range are possible depending on the system design. Prior swirlers, when only adjacent to or abutting the base plate, generally had a natural frequency of approximately 145 Hz, falling within the typical vibrational range experienced during combustion dynamics. Consequently, when a swirler is subjected to such forces, the swirler will resonate, and repeated resonance of the swirler ultimately fatigues the weld joints of the support pins.

Thus, high cycle fatigue failures are a recurring problem with respect to swirlers and other turbo machinery components. The problem has been exacerbated by combustion design changes to reduce emissions and increase efficiency. These design changes have increased the severity of the combustion dynamics, requiring more robust swirler assemblies. Therefore, there is a continuing need for a swirler assembly that can avoid vibration-induced resonance and that can further enhance the inherent damping characteristics of the swirler to constrain any vibratory motion.

SUMMARY OF THE INVENTION

It is an object of the invention to provide a swirler assembly that is adapted to tolerate the severity of the dynamics of combustors designed for reduced emissions and greater efficiencies.

It is another object of the invention to provide a more robust swirler assembly that can accommodate changes due to thermal expansion.

These and other objects of the invention are achieved by a swirler assembly adapted to interface with a supporting base plate so as to raise the resonant frequency of the swirler assembly above the vibrational range of the combustion environment and to increase the damping of the swirler response to the combustion dynamics. The present invention applies particularly to a swirler assembly that includes a swirler, a generally cylindrical swirler sleeve and a plate. The swirler has an inlet and an outlet end. The sleeve has a proximal end and a distal end. The outlet end of the swirler extends into the sleeve through the proximal end. The plate has an opening that, due to manufacturing processes, is elongated into an elliptical shape.

According one aspect of the invention, the distal end of the sleeve extends into the plate opening and contacts the inner ring-like surface of the plate opening at least partially around its periphery so that portions of the sleeve contact the surface along the minor axis of the elliptical opening and transition to a clearance along the major axis. The contact areas between the sleeve and the plate stiffen the interface and increase the natural frequency of the swirler. For example, the natural frequency can be increased to 700 Hz, well above the operational combustion dynamics, in the neighborhood of 110–150 Hz. The contact areas also increase frictional forces to damp the vibrational response of the swirler.

The sleeve preferably tapers from a larger diameter outside the plate opening down to the diameter of the portion that extends into, and preferably through, the opening. The shape of the taper preferably substantially follows the profile of the plate into the opening. The matching profile increases the areas of contact between the sleeve and the plate, increasing the stiffness and the surface area for generating frictional damping forces.

The clearance in the region of the major axis of the elliptical plate opening accommodates thermal stresses that can arise from expansion of the sleeve in the high temperature environment of the combustor. Thus, the swirler assembly according to aspects of the invention avoids resonance and damps vibrational responses while providing for thermal expansion.

In another aspect, a turbo machinery assembly includes a turbo machinery component and a plate having an opening. The opening defines an inner surface. The turbo machinery component has a first end and a second end. The second end of the turbo machinery component has an outer profile that substantially follows the inner surface and substantially adjacent to at least a portion of the plate surrounding the opening. The outer profile contacts a portion of the inner surface while providing clearance in other regions along the opening periphery. The turbo machinery assembly has a natural frequency outside of the range of operational vibrational forces and further has increased damping capability.

In still another aspect, the present invention is directed to a method for altering the natural frequency and enhancing the damping characteristics of a swirler. The method includes the steps of: providing a plate having an opening, which defines an inner surface; providing a swirler having an inlet end and an outlet end; providing a sleeve having a first end and a second end, the second end having an outer surface substantially conforming to the inner annular surface and to a portion of the plate surrounding the opening; placing the outlet end of the swirler into a first end of a sleeve; and placing the second end of the sleeve into the opening such that the second end of the sleeve substantially contacts a portion of the inner surface of the opening and adjacent to the opening while providing clearance in other regions of the opening periphery.

In a further aspect of the invention, the stabilization provided by the sleeve engagement with the base plate can permit the use of a single pin for supporting the swirler from the surrounding shell. The single pin can be cast, providing further manufacturing savings.

Thus, the invention provides a swirler assembly that can more readily endure combustion dynamics and high temperature conditions while presenting opportunities for manufacturing economies.

DETAILED DESCRIPTION OF EMBODIMENTS OF THE INVENTION

The present invention provides a more vibrationally tolerant swirler assembly and a method for making such a swirler assembly that has a natural frequency outside of the range of combustion-generated vibrational forces to preventing swirler resonance. In addition, the swirler according to aspects of the invention enhances the damping capability of the swirler assembly so as to subdue any vibrational forces acting on the system. The invention has application to various turbo machinery components. Features of the invention are, however, described with respect to fuel swirlers for use in a turbine combustor.

Figure 1:
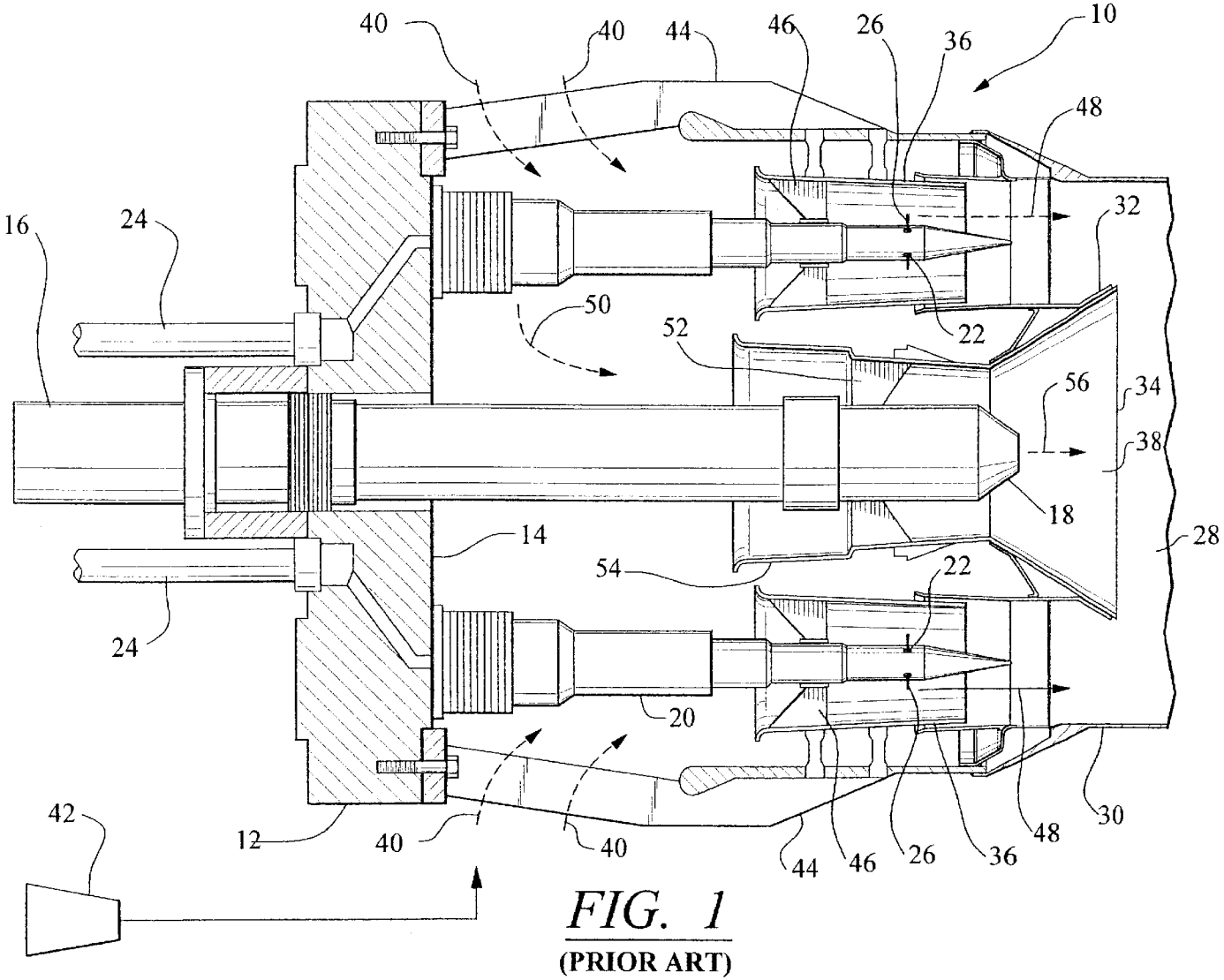
FIG. 1 (PRIOR ART)
FIG. 1 is a cross-sectional view of a prior art gas turbine combustor.
Figure 2:
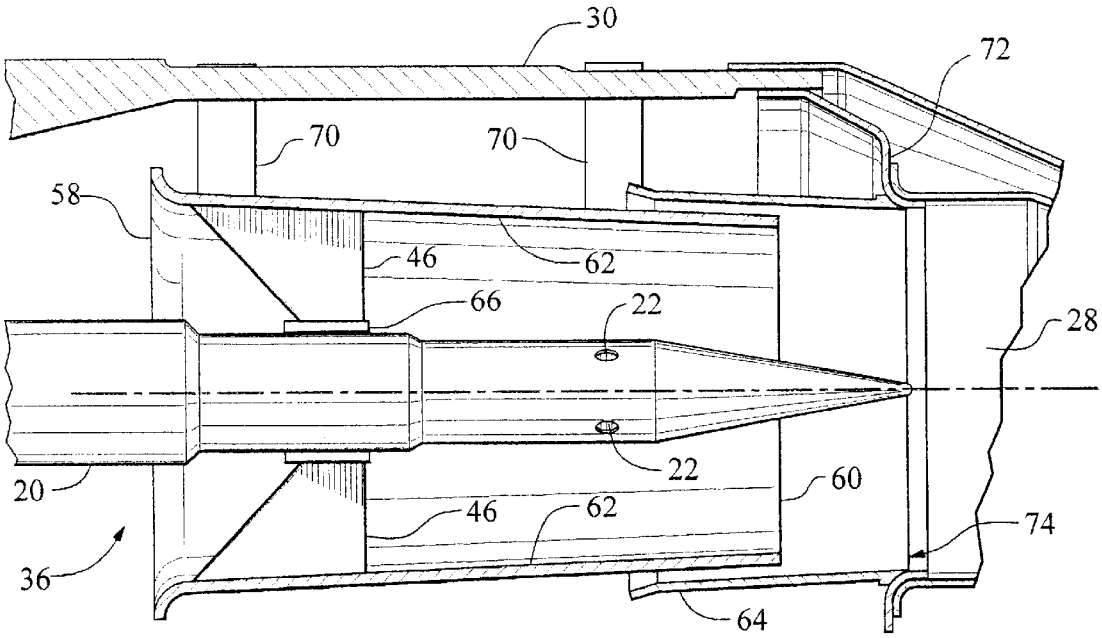
FIG. 2 (PRIOR ART)
FIG. 2 is a cross-sectional view of a prior art main fuel swirler.
Figure 3:
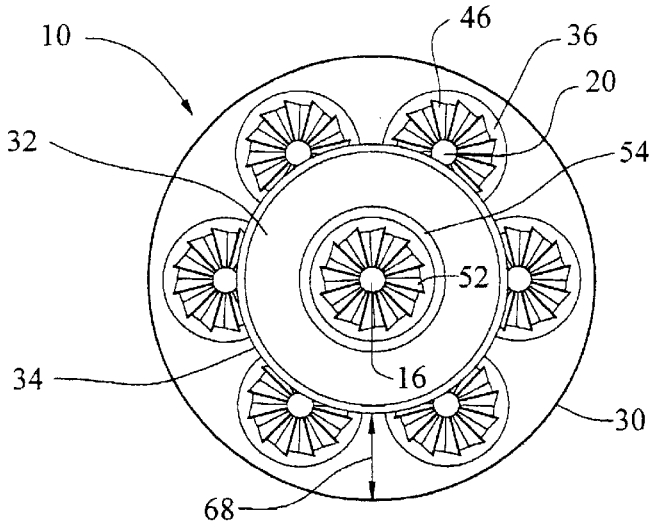
FIG. 3 (PRIOR ART)
FIG. 3 is an upstream view of a prior art gas turbine combustor.
Figure 4:
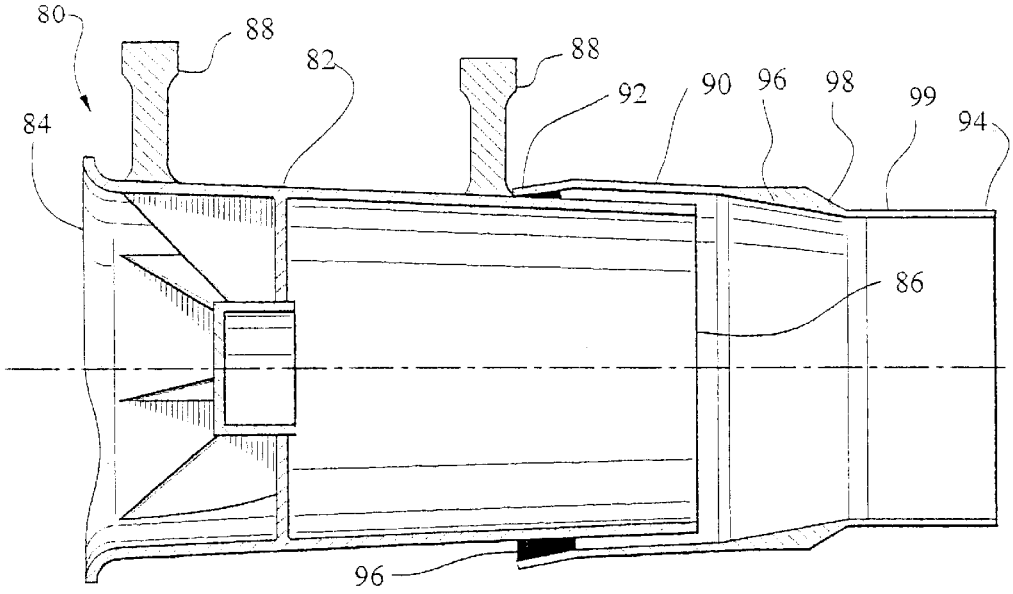
FIG. 4 is a cross-sectional view a preferred embodiment of a swirler according to the present invention.
Figure 5:
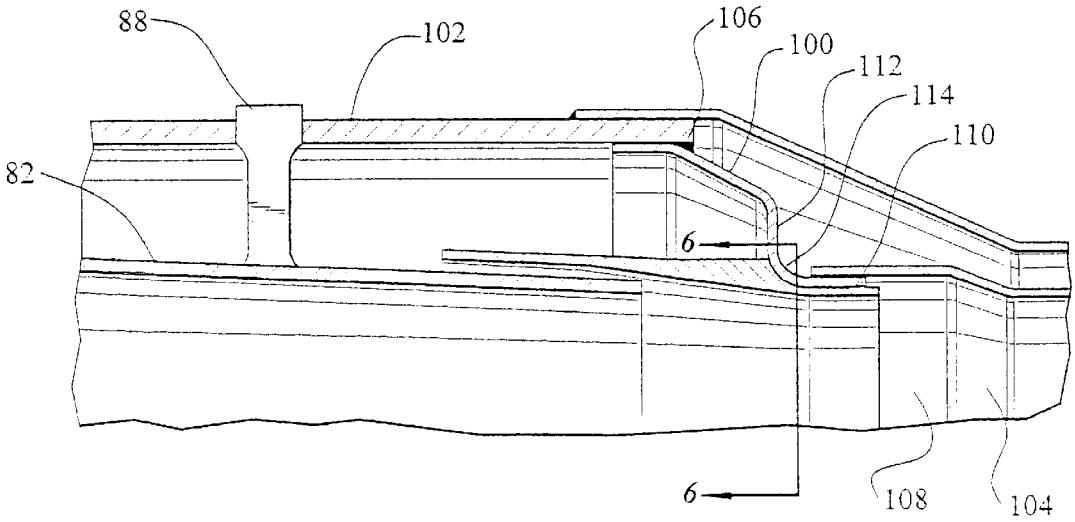
FIG. 5 is close-up view of FIG. 4, showing the engagement of the swirler and the base plate according to the present invention.

An embodiment of the swirler assembly 80 of the present invention is illustrated in FIGS. 4 and 5. In FIG. 4, an exemplary swirler 82 is shown, but the structure is not limited to swirlers and can actually be any turbo machinery component having first and second ends. Moreover, the swirler is not limited to any particular configuration, but it will generally have an inlet end 84 and an outlet end 86. Preferably, the swirler 82 is generally cylindrical in shape, but the swirler may be any shape, such as rectangular or polygonal, as dictated by design considerations and performance requirements. In the shown embodiment, the swirler tapers from its flared inlet end 84 to its outlet end 86. Like the other features of the swirler, the outer surface does not have to be tapered. For example, the swirler may have a generally uniform cross-sectional profile along its length.

The swirler 82 is supported by one or more pins 88, which can be welded to the swirler 82 at one end and welded or otherwise secured to a combustor outer liner (not shown, see FIG. 5). The pins 88 can be hour-glass shaped in profile to provide expanded welding footprints, as is known in the art. Preferably, Preferably, the swirler assembly 80 includes a sleeve 90 having a proximal end 92 and distal end 94. The sleeve 90 is preferably cylindrical in shape. However, the sleeve 90 need not be limited to a cylindrical configuration. The sleeve 90 can be made of stainless steel.

The outlet end 86 of the swirler 82 is positioned so as to extend into the proximal end 92 of the sleeve 90. Once the swirler 82 is positioned inside of the sleeve 90, the sleeve 90 and swirler 82 are welded 96 together, preferably peripherally or circumferentially in the case of a cylindrical swirler. The sleeve 90 may be a single cast component or it may be divided into first and second halves (not shown), with first half including a proximal end and a first joining end, and second half including a second joining end and a distal end, the joining ends abutted and welded circumferentially.

According to aspects of the invention, the sleeve decreases in diameter (or periphery) from its proximal end 92 to its distal end 94. Beginning at its proximal end 92, the sleeve 90 generally tapers until an area of greater thickness 96 is reached. In this area, the outer surface of the sleeve is substantially horizontal but then a second, sharper taper begins 98. This tapered 98 region can be curved instead of being linearly tapered. Eventually the taper or curve 98 transitions into a second substantially horizontal portion 99 which continues until the extreme distal end 94 of the sleeve 90 is reached.

Referring to FIG. 5, a base plate 100 supports the swirler assembly 80 and attaches the swirler assembly 80 to the outer liner 102. Commonly, the plate is made of an alloy, for example, Hastelloy X. The plate 100 is generally disposed between the swirler 82 and the combustion chamber 104. The plate 100 can be anchored to the outer liner 102 by welds 106. The plate 100 may be a single component such as a flat plate, or it may be a localized area of a larger structure.

An opening 108 is provided in the plate. The opening 108 may be a through hole or it may be, as shown, a product of bends in the plate 100. Typically, the plate 100 is shaped from a metal sheet and the openings are drawn out from the sheet. The plate is welded in place to the liner. The manufacturing processes often result in an elongation of the plate opening 108 to a generally vertical elliptical shape, as discussed more fully below.

The opening 108 is defined by a ring-like inner surface 110 that is connected to the generally vertical face 112 of the plate 100 by a convex fillet region 114. As used in this specification, the inner surface 110 is referred to as annular to describe the generally ring-like shaped of the surface. This terminology is not intended to connote that the surface is circular, when the shaped is more generally elliptical due to the elongation that occurs during manufacture.

According to the invention, the distal end 94 of the sleeve 90 extends into the opening 108, and preferably extends through and past the annular surface 110 of the opening 108. The second taper 98 is shaped to substantially follow the convex fillet 114 and the second substantially horizontal portion 99 substantially follows the inner annular surface 110 of the opening 108.

Figure 6:
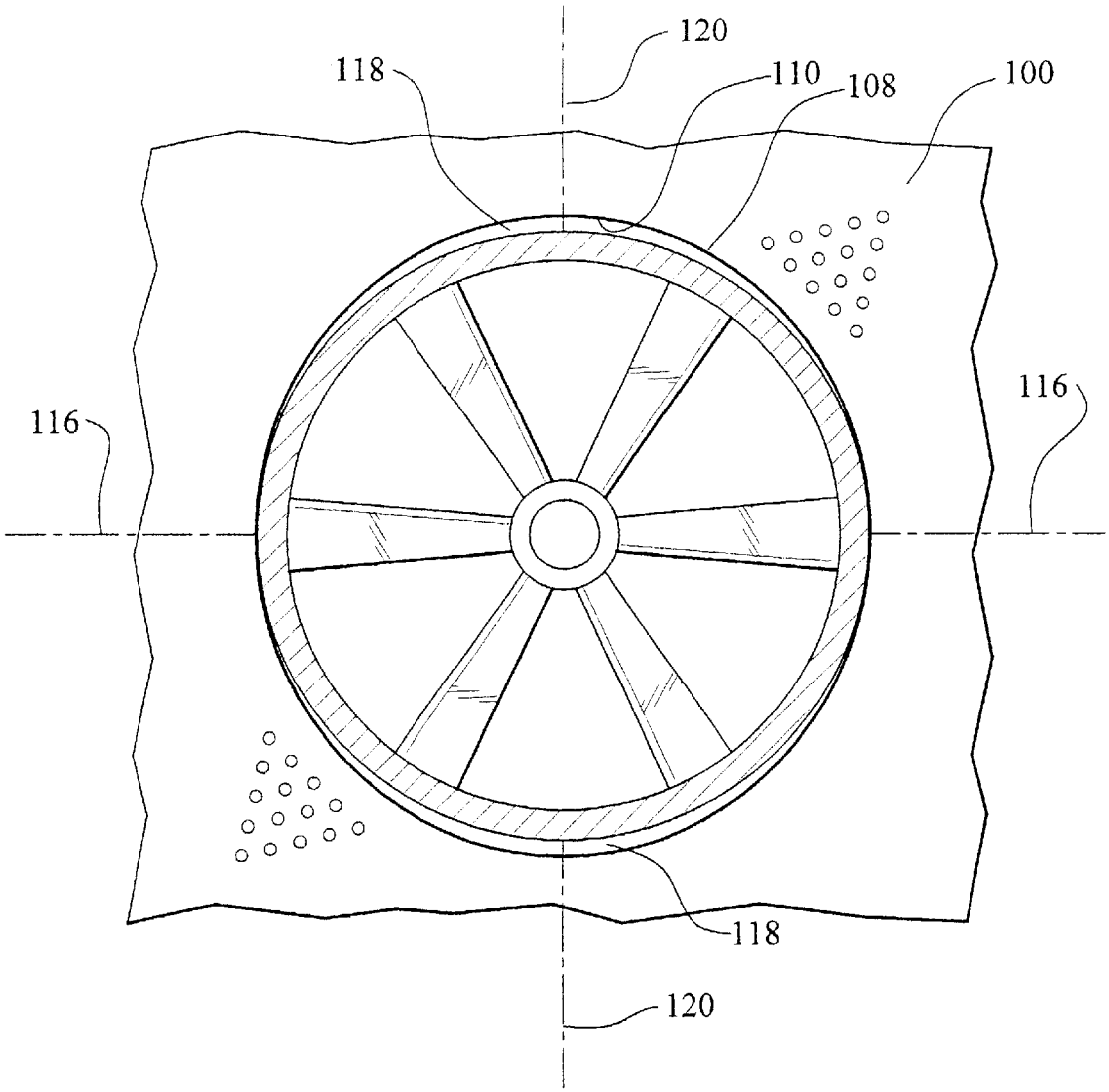
FIG. 6 is a sectional view taken along section line 6—6 in FIG. 5, showing the fit of the swirler sleeve into an elliptical opening of the base plate, exaggerated for clarity of illustration.

FIG. 6 shows a cross section of the swirler sleeve distal end 94 as inserted in the opening 108 of the base plate 100. The sleeve 90 engages the inner surface 110 of the base plate opening 108 along the minor axis 116 of the ellipse and transitions to a clearance fit 118 at along the major axis 120. In this example, the major axis 120 of the elliptical opening 108 extends substantially through the top and bottom of the opening while the minor axis extends across the left and right sides. This orientation corresponds to the general tendency of the base plate opening 108 to elongate vertically during manufacture. The orientation can of course deviate from this example.

The degree of elongation and the percentage of the inner surface 110 that is contacted can vary. With tolerances of the preferably circular sleeve to an average of the elliptical dimensions, the percentage of surface contact is preferably around 70%.

The clearance 118 in the region of the elliptical major axis 120 is preferably in the range of 0–3 mils. The resonant frequency is directly related to the percentage of contact and inversely related the degree of clearance. Further, the clearance region 118 allows for thermal expansion of the sleeve 90, thus reducing thermal stresses in the high temperature environment of a turbine combustor.

Referring again to FIG. 5, the area of contact not only serves to increase the resonant frequency outside the range of combustion dynamics, but also generates frictional forces that damp the vibrational response of the swirler. The areas of friction are further increased by the taper 98 of the sleeve 90 that substantially mimics the convex fillet 114 of the plate 100. In the regions of contact of the inner surface 110, there can be a corresponding contact along the convex fillet region 114.

With the increase stability provided by the nested sleeve, the swirler can be supported by a single pin 88, located generally centrally, instead of a pair of spaced pins. Moreover, the pins 88 can be cast as hollow members with the rest of the cast swirler, and increased in diameter to maintain proper strength in view of its hollow interior (not shown).

The pin 88, whether a single or a pair can be reinforced at its junction with the swirler main body 82. One approach is to thicken the body in the region of the pin.

The preferred embodiment of the swirler assembly 80 employs a sleeve 90. Of course, a sleeve 90 may not be necessary in the assembly so long as the outlet end 86 of the swirler 82 or other turbo machinery component substantially follows the opening 108 in the plate 100 and substantially adjacent to a portion of the plate surrounding the opening to provide a hybrid contact and clearance fit with the surfaces in and around the opening.

The present invention is also directed to a method for altering the natural frequency and enhancing the damping characteristics of a swirler. Steps include, in no particular order, providing a plate 100 having an opening 108 that defines an inner annular surface 110; providing a swirler 82 having inlet 84 and outlet 86 ends; and providing a sleeve 90 having first 92 and second 94 ends. The second end 94 of the sleeve 90 has an outer surface substantially conforming to the inner annular surface 110 of the opening 108 and also to a portion of the plate 100 surrounding the opening 214 such that contact occurs in certain regions while other regions are spaced. The outlet end 86 of the swirler 82 is placed into the first end 92 of the sleeve 90. Additionally, the swirler 82 may be secured to the sleeve 90 by, for example, welding. The second end 94 of the sleeve 90 is substantially matingly fitted into and at least partially beyond the inner annular surface 110 of the opening 108 and substantially adjacent to a portion of the plate 100 surrounding the opening 108.

In operation, the swirler assembly 80 described above has a natural frequency out of the range of commonly experienced combustion dynamic vibrational forces. As noted earlier, combustion dynamics typically range from approximately 110 Hz to 150 Hz. Tests on a swirler assembly according to principles of the present invention reveal a natural frequency as high as approximately 700 Hz. The increased natural frequency can vary as a function of the percent of the swirler sleeve in contact with the inner surface of the base plate opening and the amount of clearance in the areas of separation, but the resonant frequency is nevertheless well above the operational frequency range of the combustion environment. Accordingly, the combustion dynamic vibration will not cause the swirler to resonate and ultimately cause some part or connection to fail due to fatigue. The surface areas of contact generate frictional forces to damp the vibrational response of the swirler, and the clearance regions permit the arrangement to thermally expand.

It will of course be understood that the invention is not limited to the specific details described herein, which are given by way of example only, and that various modifications and alterations are possible within the scope of the invention as defined in the appended claims.

What is claimed is:

1. A swirler assembly comprising:

a swirler having an inlet end and an outlet end;

a sleeve having a proximal end and a distal end, wherein said outlet end of said swirler extends into said sleeve through said proximal end;

a plate having an opening, said opening defining an inner annular surface, said annular surface being elliptical and defining a minor axis and a longer major axis transverse to the minor axis;

wherein said distal end of said sleeve extends into said opening and contacts at least a portion of said inner annular surface, whereby said swirler assembly has a natural frequency outside of the range of operational vibrational forces in a combustor and further having enhanced damping characteristics.

2. The swirler assembly according to claim 1, wherein said distal end contacts said inner annular surface substantially at points along said minor axis and transitions to a clearance from said annular surface substantially at points along said major axis.

3. The swirler assembly according to claim 2, wherein said sleeve contacts said inner annular surface along approximately 70 percent of said inner annular surface.

4. The swirler assembly according to claim 3, wherein said clearance ranges from approximately 0 to approximately 3 mils.

5. The swirler assembly according to claim 2, wherein said swirler comprises a sole support pin extending from said swirler.

6. The swirler assembly according to claim 5, wherein said support pin is cast as part of said swirler.

7. The swirler assembly according to claim 1, wherein said sleeve extends axially past said inner annular surface.

8. The swirler assembly according to claim 1, wherein said plate defines a profile transitioning from a planar face through a convex fillet to said inner annular surface, said sleeve having a tapering profile such that the sleeve profile substantially follows the convex fillet and inner annular surface profile in shape.

9. The swirler assembly of claim 1, wherein said sleeve is circumferentially welded to said swirler.

10. The swirler assembly of claim 1, wherein said sleeve is divided into a first half and a second half; said first half including said proximal end and a first joining end, said second half including a second joining end and said distal end, said joining ends being circumferentially welded together.

11. A turbo machinery assembly comprising:

a turbo machinery component having a first end and a second end; said second end having an outer profile;

a plate having a radially-elongated opening, said elongated opening defining an inner surface;

wherein said outer profile of said second end of said turbo machinery component extends inside said opening and contacts portions of said inner surface and extends peripherally to regions of clearance with said inner surface; and whereby said turbo machinery assembly has a natural frequency outside of the range of operational vibrational forces and further has increased damping capability.

12. The turbo machinery assembly of claim 11, wherein said second end of said turbo machinery component further extends beyond said inner surface.

13. The turbo machinery assembly of claim 11, wherein said turbo machinery component includes a sleeve having a proximal end and a distal end, wherein said turbo machinery component extends into said sleeve through said proximal end, and wherein said distal end of said sleeve defines said second end of said turbo machinery component extending inside said inner surface.

14. A swirler assembly, comprising:

a swirler having an inlet end and an outlet end and a plurality of swirler vanes therebetween;

a sleeve having a proximal end and a distal end, wherein said outlet end of said swirler extends into said sleeve through said proximal end and is secured to said sleeve by welding;

a plate having a profile of a planar face transitioning through a convex fillet to an elliptical opening, said elliptical opening defining an inner elliptical annular surface defining a minor axis and a longer major axis transverse to said minor axis;

wherein said sleeve has a tapering profile from a first diameter proximate said swirler weld to said distal end, said tapering profile including a concave taper substantially following the convex fillet of said plate and transitioning to a straight profile substantially following said inner annular surface; and said sleeve extending into said opening and contacting said plate at said convex fillet and said inner annular surface at points along said minor axis and transitioning to a clearance with said inner annular surface and said convex fillet at points along said major axis, wherein at least approximately 50% of said inner annular surface is contacted and the clearance is less than approximately 3 mils, whereby said swirler assembly has a natural frequency outside of the range of operational vibrational forces in a combustor and further having enhanced damping characteristics, and said clearance permits thermal expansion of said sleeve.

* * * * *